US005642700A

United States Patent [19]

Ikegaya et al.

[11] Patent Number: 5,642,700

[45] Date of Patent: Jul. 1, 1997

[54] SLIDING CONTACT-MAKING STRUCTURES IN INTERNAL COMBUSTION ENGINE AND METHOD FOR PRODUCING SAME

[75] Inventors: Hirohiko Ikegaya; Yasuyuki Murase, both of Iwata, Japan

[73] Assignee: Yamaha Hatsudoki Kabushiki Kaisha, Iwata, Japan

[21] Appl. No.: 631,994

[22] Filed: Apr. 15, 1996

Related U.S. Application Data

[62] Division of Ser. No. 480,451, Jun. 7, 1995.

[30] Foreign Application Priority Data

Dec. 26, 1994 [JP] Japan ..... 6-337889

[51] Int. Cl.[6] ..... F02F 5/00

[52] U.S. Cl. ..... 123/193.2; 29/888.061; 205/109

[58] Field of Search ..... 123/193.2, 193.4, 123/668; 29/888, 888.061; 92/169.1; 205/50, 109; 428/547, 548

[56] References Cited

U.S. PATENT DOCUMENTS

| | | | |
|---|---|---|---|
| 3,932,228 | 1/1976 | Sugiyama et al. | 123/193.2 |
| 3,981,781 | 9/1976 | Mori et al. | 204/16 |
| 5,516,417 | 5/1996 | Kondou et al. | 205/109 |
| 5,520,791 | 5/1996 | Murase | 205/50 |
| 5,540,829 | 7/1996 | Mase et al. | 205/109 |
| 5,549,086 | 8/1996 | Ozawa et al. | 123/193.2 |

*Primary Examiner*—MarGuerite McMahon

*Attorney, Agent, or Firm*—Knobbe, Martens, Olson & Bear LLP

[57] ABSTRACT

Sliding contact-making structures of an internal combustion engine, comprising (a) a cylinder unit having an inner plating coating containing a dispersoid substance; and (b) a piston provided with at least one piston ring, fitted into the inside of said cylinder unit in the axial direction so as to freely slide upon the inside surface thereof, wherein the thickness of the plating coating is tapered off in the axial direction at the edge of the plating coating on the side of a crankshaft, and/or the dispersoid content in said plating coating not in sliding contact with the piston ring, on the side of a crankshaft, is lower than that in sliding contact with the piston ring, thereby preventing peeling off of the plating coating and unnecessary abrasion of the piston as well as seizing, extending the life of the cylinder.

9 Claims, 3 Drawing Sheets

SLIDING CONTACT-MAKING STRUCTURES IN INTERNAL COMBUSTION ENGINE AND METHOD FOR PRODUCING SAME

This application is a divisional of U.S. patent application Ser. No. 08/480,451, filed Jun. 7, 1995.

BACKGROUND

1. Field of the Invention

This invention relates to sliding contact-making structures constituted by a sleeveless cylinder and a piston of an internal combustion engine installed in an automobile, motorbike and the like, in particular, to such sliding contact-making structures allowing for preventing a plating coating deposited on the inside surface of the cylinder from peeling off, and preventing abrasion of both the plating coating and the skirt area of the piston. This invention also relates to a method for producing the above structure.

2. Background of the Art

A cylinder of a combustion engine normally comprises a cylinder unit and a piston which is fitted into the cylinder unit so as to freely slide in contact with the inside surface of the cylinder unit. In the above structure, the piston reciprocally slides upon the inside surface of the cylinder unit at a high speed when operated. As a result, frictional wear or seize tends to occur between the inside surface of the cylinder unit and the outer surface of the piston. In order to prevent such a problem, a cylinder unit wherein a plating coating with a high degree of hardness is formed on the inside surface is hitherto known. However, mere formation of a plating coating on the inside surface of the cylinder unit is not sufficient, and the following drawbacks may be associated with the plating coating.

First, near the end of the inside surface of the above cylinder unit on the side of a crankshaft, there is a step-like edge formed by the plating coating where it ends abruptly. Since there is play between the outermost surface of a piston skirt and the inside surface of the cylinder unit to allow the piston to smoothly slide upon the inside surface of the cylinder, the lower edge of the piston skirt reciprocally touches the very end or an adjacent area near the end of the plating coating, i.e., the step-like edge. As a result, the stress or impact caused by the above action of the piston when operated tends to be focused at the step-like edge of the plating coating, and the plating coating is prone to peel off from the step-like edge. Consequently, the life of the cylinder will be shortened.

Secondly, a piston normally comprises a piston body and at least one piston ring which is circumferentially installed at the outer surface of the piston body so as to contact the inside surface of the cylinder when sliding thereon. Airtightness of a combustion chamber is assured mainly at the outer surface of the piston ring in sliding contact. For this reason, matching the hardness of the inside surface of the cylinder (the plating coating), the piston ring has a sufficient hardness resistant to friction wear relative to the piston body in order to prevent friction wear occurring on the surface in sliding contact. However, not only the piston ring but also the piston body inevitably touches the inside surface of the cylinder when sliding, despite the fact that there is play between the piston body and the inside surface of the cylinder, resulting in friction wear unnecessarily occurring on the piston body itself, .especially the skirt area. Consequently, the life of the cylinder will be shortened.

SUMMARY OF THE INVENTION

The present invention has exploited sliding contact-making structures in a cylinder unit and a piston which improve the life of the cylinder. An objective of the present invention is to provide sliding contact-making structures allowing for prevention of peeling off of the plating coating from the base material of the cylinder unit, whereby the life of the cylinder is prolonged. The sliding contact-making structures also allow for prevention of unnecessary friction wear on the sliding surface of the piston body, whereby the life of the cylinder is further prolonged.

Namely, one important aspect of the present invention is sliding contact-making structures of an internal combustion engine, comprising: (a) a cylinder unit having an inner plating coating containing a dispersoid substance, wherein the thickness of said plating coating is tapered off in the axial direction at the edge of said plating coating on the side of a crankshaft; and (b) a piston provided with at least one piston ring, fitted into the inside of said cylinder unit in the axial direction so as to freely slide upon the inside surface thereof. By reducing the thickness of the inside surface of the cylinder unit in the axial direction at the edge of the plating coating, i.e., by forming no step-like edge, it is possible to prevent the edge from peeling off from the base material of the cylinder unit since the stress or impact focused on the edge caused by reciprocal sliding of the piston upon the inside surface can be abated and the edge can remain adhesive. The plating coating in sliding contact has a thickness of preferably 10–200 μm, and the thickness is reduced at a slant down to zero in 1–2 mm of length in the axial direction of said cylinder unit. Consequently, the life of the cylinder can be prolonged.

From the point of view that the lower edge of the piston reciprocally touches the inside surface of the cylinder unit, the slanting reduction of the thickness in the above structure preferably starts approximately at the lower dead point position of said piston.

If the preferred method described later is employed to form the above plating coating, the inside surface of the cylinder has an unplated marginal portion near the bottom end of the inside surface of the cylinder unit.

In the above structures, the dispersoid content in the plating coating not in sliding contact with the piston ring, on the side of a crankshaft, can be lower than that in sliding contact with the piston ring, preferably reduced at a slant in the axial direction. In this embodiment, although not only the piston ring but also the piston body inevitably touches the plating coating of the cylinder (preferably formed of abrasion-resistant material, a nickel-based plating coating containing a silicon carbon dispersoid, e.g., 0.2–10% of the silicon carbon dispersoid) when sliding, unnecessary friction wear occurring on relatively soft material, the piston body itself, especially the skirt area, can be prevented. Consequently, the life of the cylinder can be prolonged. Preferably, the dispersoid content in said plating coating in sliding contact with the piston ring is substantially constant in the axial direction, so that abrasion in sliding contact can be efficiently prevented.

Another important aspect of the present invention is the above embodiments regarding the dispersoid content adopted independently of the embodiments regarding the thickness of the plating coating in order to prevent abrasion of the piston.

Still another aspect of the present invention is an internal combustion engine comprising the above sliding contact-making structures regarding the thickness of the plating coating, the dispersoid content of the plating coating, or both. This internal combustion engine exhibits the aforesaid effects, and further, in the case that the edge of the end of the inside surface of the cylinder unit on the side of a combustion chamber is rounded off, exhaust residues such as carbon are not easily deposited on the edge of the cylinder unit on the side of a combustion chamber.

Yet another important aspect of the present invention is a method for forming the plating coating whose thickness is reduced at the edge on the side of a crankshaft, comprising the steps of: (a) sealing one end of a cylinder unit on the side of a crankshaft by fitting a cover having a sealing portion circumferentially provided on the side into the inside of the cylinder unit, wherein the sealing portion circumferentially touches the inside surface of the cylinder unit near said end of the cylinder, and a gap is formed circumferentially by the side of the cover, the sealing portion and the inside surface of the cylinder unit; (b) inserting an electrode inside said cylinder unit from the other end of the cylinder unit; (c) permitting a plating liquid containing a dispersoid substance-forming material to flow in a path formed by the inside surface of the cylinder unit, the electrode and the cover; and (d) impressing a voltage between said inside surface of the cylinder unit and said electrode to give an electric current density therebetween so as to form a plating coating on said surface of the cylinder unit, wherein said electrode is positive while said inside surface of the cylinder unit is negative, whereby the thickness of said plating coating on the inside surface of the cylinder unit is tapered off in the axial direction in the vicinity of the circumferential gap.

Still another important aspect of the present invention is a method for forming the plating coating in which the dispersoid content is reduced down towards the edge on the side of a crankshaft, comprising the steps of: (a) sealing one end of a cylinder unit on the side of a crankshaft with a cover; (b) inserting an electrode inside said cylinder unit from the other end of the cylinder in such a way that the lengthwise side of said electrode is parallel to the inside surface of the cylinder unit; (c) permitting a plating liquid containing a dispersoid substance-forming material to flow in a path formed by the inside surface of the cylinder unit, the electrode and the cover; and (d) impressing a voltage between said inside surface of the cylinder unit and said electrode to give an electric current density therebetween so as to form a plating coating on said surface of the cylinder unit, wherein said electrode is positive while said inside surface of the cylinder unit is negative, under the conditions that the distance between the end of the electrode near the cover and the inside surface of the cylinder not parallel to the lengthwise side of the electrode on the side of a crankshaft is greater than the distance between the lengthwise side of the electrode and the inside surface of the cylinder parallel thereto, whereby the dispersoid content in the plating coating not in sliding contact with a piston ring, on the side of a crankshaft, is lower than that in sliding contact with the piston ring. Preferably, in step (d), the end of the electrode is placed between the cover and a position corresponding in the axial direction to the lower dead point position of a piston ring, so that the desired distribution of the dispersoid content can be efficiently achieved.

Another important aspect of the present invention is a combination of the above two methods to obtain sliding contact-making structures which have both features, i.e., the tapered edge of the plating coating, and the reduced dispersoid content near the edge. Based on the above methods, the aforesaid sliding contact-making structures can be efficiently obtained.

DETAILED DESCRIPTION OF THE PREFERRED EMBODIMENTS

Figure 1:
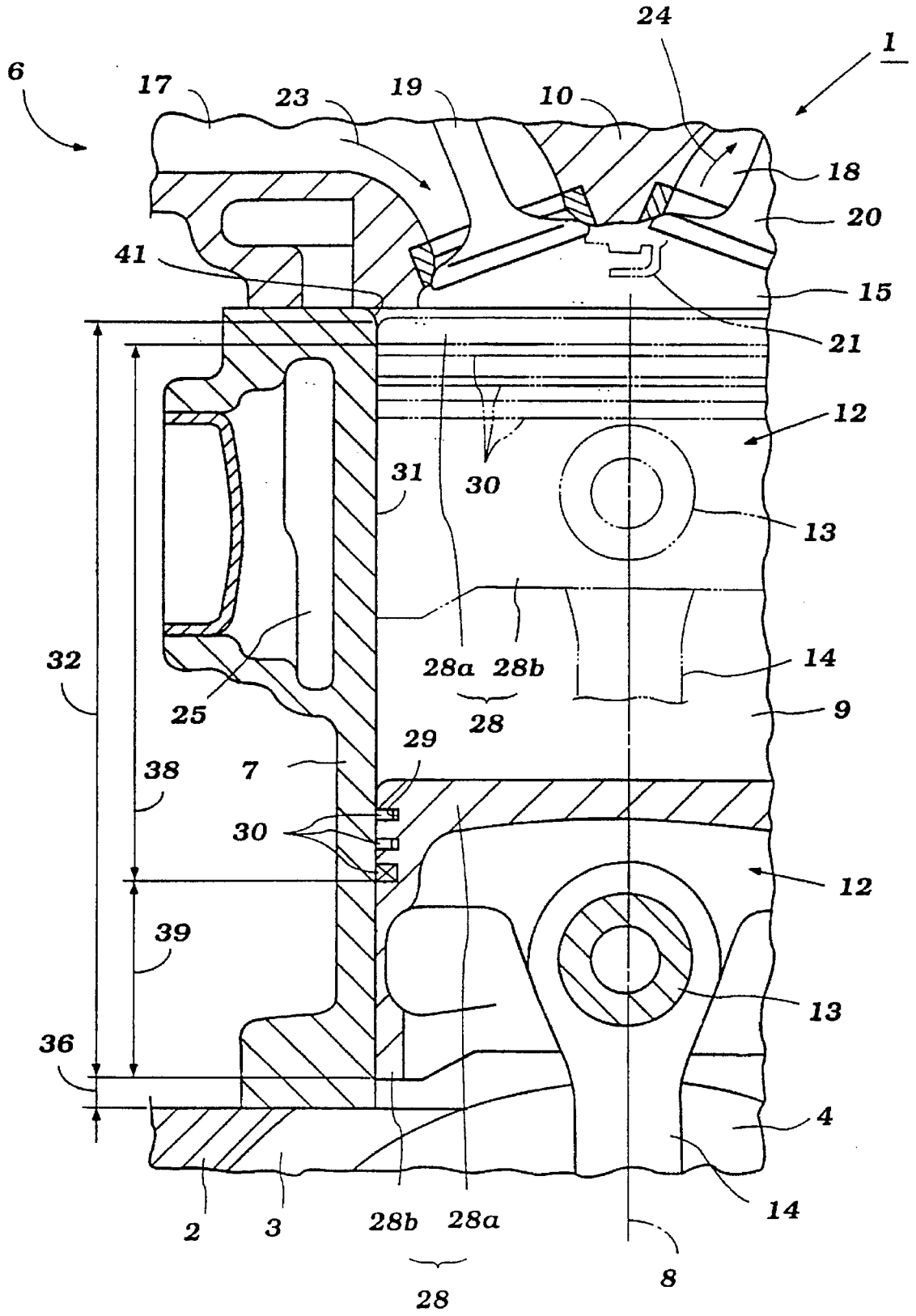
FIG. 1 is a schematic vertical cross-sectional view (a part) showing one embodiment of an internal combustion engine having sliding contact-making structures of the present invention. The broken line (two-dash) shows the upper dead point position of the piston while the solid line shows the lower dead point position of the piston.

Sliding Contact-Making Structures in Internal Combustion Engine

Sliding contact-making structures of the present invention can be adapted for any internal combustion engine for any purpose, in which a piston slides upon the inside surface of a cylinder unit, such as automobile engines, motorcycle engines and lawn mower engines, regardless of whether they are two-cycle or four-cycle engines. However, the present invention is advantageously and preferably applied to a four-cycle engine since problems associated with sliding contact-making structures tend to be more significant in four-cycle engines due to lubricating oil being used as little as possible. The piston has at least one piston ring, normally two (i.e., a compression ring and an oil ring) or three (i.e., a compression ring, second compression ring and oil ring), installed circumferentially along the piston body. The outermost area of the piston ring, i.e., the surface in sliding contact, slides upon the inside surface of the cylinder unit while touching the inside surface. Thus, the sliding contact-making structures are mainly composed of the inside surface of the cylinder unit and the sliding surface of the piston. A cylinder unit used in the present invention is a sleeveless cylinder plated with a plating coating. A sleeveless cylinder is lightweight, and not prone to heat deformation so that local frictional wear does not practically occur. A cylinder is compact and lighter when an aluminum alloy is used and plated with chrome or nickel to increase the abrasion resistance of the inside surface of the cylinder. However, other alloys or even plastic can be used for a cylinder unit.

Plating Coating on Inside Cylinder Surface

The plating coating should have sufficient lubricity, frictional properties, hardness and so forth, and from this point of view, a nickel-based or chrome-based plating coating, especially a nickel-based plating coating containing a dispersoid substance, is preferred. As a dispersoid-forming substance, ceramics such as silicon carbide and alumina can be used. For example, a nickel-based plating coating containing a silicon carbide dispersoid (normally 0.2%–10%, preferably 1.5–3.5% by weight), Ni-Sic, is preferably used. Alternatively, the nickel-based plating coating further containing phosphorus (preferably 0.5%–1% by weight), Ni—P—SiC, can be used to match the hardness of the sliding surface of a piston in the case that the sliding surface of the piston ring is hard. If the sliding surface of a piston is not hard, the plating coating need not contain phosphorus. The thickness of the plating coating can vary, but may be 10–200 μm, preferably 30–100 μm after honing treatment.

The plating coating should cover the area in which an upper piston ring (compression ring) slides, i.e., the area from the point the upper piston ring reaches when the piston is at the upper dead point position, to the point the lower piston ring (oil ring) reaches when the piston is at the lower dead point position, because these piston rings are reciprocally touching the inside surface of the cylinder unit when operated. If only one piston ring is installed, the plating coating should cover between the upper and lower dead point positions of the piston for the same reason. However, preferably, the plating coating also covers the area which the piston skirt touches, i.e., the area between the lower dead point positions of the piston ring and the piston skirt, so that the inside surface which the piston skirt touches will not easily be abraded.

If a high speed plating system in which plating liquid flows is adapted to the present invention (described later), a cover is preferably fitted into the inside of the cylinder unit to seal the cylinder unit in which the plating liquid flows. Accordingly, the bottom end of the cylinder unit on the side of a crankshaft has an unplated circumferential area used for sealing the cylinder unit with the cover.

Thickness of Plating Coating at Edge

In one embodiment of the present invention, the thickness of the plating coating on the inside surface of a cylinder unit is tapered off in the axial direction at the edge on the side of a crankshaft. Due to play between a piston skirt and the inside surface of the cylinder unit, the piston skirt reciprocally touches the inside surface of the cylinder unit which is covered with a plating coating. Since the edge of the plating coating is tapered in the present invention, stress or impact caused by the above action can be eased. Even if such stress or impact is focused on the edge, the edge will not be peeled off since the thickness of the edge is tapered off a slant and the adhesive strength is relatively great.

The starting point of the tapering of the thickness depends on the endpoint of the plating coating, However, the tapering of the thickness should start below the lower dead point position of a piston ring, preferably starts approximately at the lowest dead point position of a piston skirt. The taper of the reduction can be linear, exponential, logarithmic or a combination thereof. The reduction is preferably in a reversed "S" shape, i.e., gradually reduced from the initial thickness, linearly reduced and then gradually reduced to zero. In practice, the thickness is tapered down to zero in 1–2 mm of length in the axial direction of the cylinder unit, so that the edge is not easily peeled off as compared with a conventional step-like edge.

Dispersoid Content near Edge

In another embodiment of sliding contact-making structures in the present invention, the dispersoid content in the plating coating not in sliding contact with a piston ring, on the side of a crankshaft, is lower than that in sliding contact with the piston ring. The plating coating containing a dispersoid, e.g., Ni—SiC, has a hardness sufficient to resist reciprocal sliding of a piston ring whose surface is made of hard material such as nitrided SUS. On the other hand, the plating coating is harder than the material of a piston skirt, resulting in that the piston skirt tends to be abraded. If the piston skirt is abraded, the friction between the piston skirt and the inside surface of the cylinder unit tends to increase, resulting in that the piston is prone to seizing. As a result, the life of the cylinder is shortened. In the present invention, the area which is predominantly touched by the piston skirt, not the piston ring, is plated with a coating containing less dispersoid substance to match the hardness of the piston skirt, so that the piston skirt will not be unnecessarily abraded. On the other hand, if the dispersoid content in the plating coating in sliding contact with the piston ring is substantially constant in the axial direction, resistance to abrasion can be efficiently achieved.

The reduction of the dispersoid content can be in steps or continuous. Tapered reduction is preferable in view of production processes (described later). That is, the dispersoid content in the plating coating not in sliding contact with the piston ring, on the side of a crankshaft, is tapered down in the axial direction.

A COMBINATION OF TAPERED EDGE AND REDUCED DISPERSOID CONTENT NEAR THE EDGE

The aforesaid two embodiments are entirely independent of each other. However, they can be combined to obtain sliding contact-making structures having both features, i.e., prevention of peeling off of the plating coating at the edge and prevention of abrasion of the piston skirt and seizing, both contributing to prolonging the life of the cylinder.

OTHER FEATURES

There is no special constraint on the other end of the plating coating, the end on the side of a combustion chamber, as long as the plating coating extends to the upper dead point position of the piston ring. However, if the edge of the end of the inside surface of the cylinder unit on the side of a combustion chamber is rounded off, exhaust residues such as carbon are not easily deposited on the edge. The rounded off area is not necessarily plated, but if a high speed plating system is employed, the area will be plated as well, and no adverse effects will occur.

METHOD FOR FORMING TAPERED EDGE OF PLATING COATING

The plating coating having a tapered edge on the side of a crankshaft can be produced based on the following principle. That is, the deposition speed of a plating coating varies depending on the flow speed of the plating liquid, the concentration of electrolyzed metal and the like, especially the electric current density. For example, if the flow rate of plating liquid is 1.0–3.0 m/sec and the electric current density is 20–200 A/dm$^2$, the deposition speed is 20–30 μm/min, while if plating liquid does not flow and the electric current density is 20 A/dm$^2$ or less, the deposition speed is 0.5–3 μm/min. Thus, at the area where the thickness of the plating coating should be thin, a structure which locally makes the electric current low, for example, can be advantageously adapted. The electric current density is correlated with the distance between the electrode and the surface (i.e., the other electrode) to be plated.

Such a method is that for forming a plating coating on the inside surface of a cylinder unit of an internal combustion engine, comprising the steps of: (a) sealing one end of a cylinder unit on the side of a crankshaft by fitting a cover having a sealing portion circumferentially provided on the side into the inside of the cylinder unit, wherein the sealing portion circumferentially touches the inside surface of the cylinder unit near said end of the cylinder, and a gap is formed circumferentially by the side of the cover, the sealing portion and the inside surface of the cylinder unit; (b) inserting an electrode inside said cylinder unit from the other end of the cylinder unit; (c) permitting a plating liquid containing a dispersoid substance-forming material to flow in a path formed by the inside surface of the cylinder unit, the electrode and the cover; and (d) impressing a voltage between said inside surface of the cylinder unit and said electrode to give an electric current density therebetween so as to form a plating coating on said surface of the cylinder unit, wherein said electrode is positive while said inside surface of the cylinder unit is negative, whereby the thickness of said plating coating on the inside surface of the cylinder unit is tapered in the axial direction in the vicinity of the circumferential gap.

Based on the above method, if the edge of the cylinder unit on the other side, i.e., the side of a combustion chamber is rounded off for the sake of prevention of deposition of exhaust residues such as carbon thereon, the thickness of the plating coating in the rounded off area is reduced by the same mechanism as above.

Any other plating methods which allow for formation of a plating coating containing a dispersoid substance can be adapted in the present invention. However, a high speed plating method, i.e., a flowing liquid plating system or a circulation plating system, is preferably employed. For example, a plating liquid such as a nickel sulfamate bath or a nickel surfate bath which optionally contains phosphorus of 0.1–0.3 g/l is permitted to flow on the surface of a cylinder at a plating liquid flow rate of 1.0 to 7.0 meters per second (preferably 2.0 to 6.0 meters per second) while impressing a voltage between an electrode and the surface at an electric current density of 20 to 400 A/dm$^2$ (preferably 50 to 300 A/dm$^2$). During plating, the flow rate and the electric current density can be changed continuously or at intervals so as to change the distribution of a dispersoid substance in the plating coating.

In addition, the electrode is preferably made of material, preferably nickel, with which the inside surface of the cylinder unit is plated by electrolyzing the material, so that plating can be efficiently conducted.

Methods other than the above are possible. For example, after plating a cylinder unit, the edge of the plating coating on the side of a crankshaft can be physically tapered off by honing treatment technologies.

METHOD FOR FORMING REDUCED DISPERSOID CONTENT NEAR THE EDGE

The plating coating having a tapered reduction of the dispersoid content near the edge on the side of a crankshaft can be produced based on the following principle. That is, the dispersoid content of a plating coating varies depending on the electric current density, the concentration of electrolyzed metal and the like, especially the flow speed of plating liquid. For example, if the flow rate and the electric current density are moderate (e.g., 2.0–3.0 mls and 50–100 A/dm$^2$), a significant amount of a dispersoid will be formed in a plating coating, while if the flow rate and the electric current density are lower or higher than the above, less dispersoid will be formed in a plating coating.

Such a method is that for forming a plating coating on the inside surface of a cylinder unit of an internal combustion engine, comprising the steps of: (a) sealing one end of a cylinder unit on the side of a crankshaft with a cover; (b) inserting an electrode inside said cylinder unit from the other end of the cylinder in such a way that the lengthwise side of said electrode is parallel to the inside surface of the cylinder unit; (c) permitting a plating liquid containing a dispersoid substance-forming material to flow in a path formed by the inside surface of the cylinder unit, the electrode and the cover; and (d) impressing a voltage between said inside surface of the cylinder unit and said electrode to give an electric current density therebetween so as to form a plating coating on said surface of the cylinder unit, wherein said electrode is positive while said inside surface of the cylinder unit is negative, under the conditions that the distance between the end of the electrode near the cover and the inside surface of the cylinder not parallel to the lengthwise side of the electrode on the side of a crankshaft is greater than the distance between the lengthwise side of the electrode and the inside surface of the cylinder parallel thereto, whereby the dispersoid content in the plating coating not in sliding contact with a piston ring, on the side of a crankshaft, is lower than that in sliding contact with the piston ring.

Several means can be adapted for obtaining a wider distance between the electrode and a lower area (the crankshaft side) of the inside surface of the cylinder unit in order to reduce the dispersoid content in the plating coating near the edge on the side of a crankshaft. The easiest means therefor is that an electrode is inserted into the inside of the cylinder unit in such a way that the end of the electrode is placed between the cover and a position corresponding in the axial direction to the lower dead point position of a piston ring. As a result, in the area lower (closer to the edge on the side of a crankshaft) than the end of the electrode in the axial direction, the electric current density is rendered weaker, resulting in a lower dispersoid content in the area. In this case, the dispersoid content is reduced exponentially. Alternatively, the electrode can be moved gradually or at intervals towards the side of a combustion chamber while impressing a voltage, so that the dispersoid content in the area near the end on the side of a crankshaft is reduced gradually or at intervals. Further, in order to control the flow and the electric current density, it is possible to move a work itself or to rotate an electrode so as to permit the plating liquid to flow.

The other means in the aforesaid method can be the same as in that for a plating coating having a reduced thickness at the edge.

A COMBINATION OF TWO METHODS

The aforesaid two methods are independent of each other. That is, in the former method, the electrode can be inserted all the way down to the cover while, in the latter method, the sealing portion can be provided on the top of the cover, not the side. However, these two methods can be efficiently and readily combined to obtain a plating coating having both features, i.e., tapered thickness at the edge and a reduced dispersoid content near the edge.

EXAMPLE: Combustion Engine With Plating Coating Having Reduced Thickness And A Reduced Dispersoid Content

Combustion Engine

FIG. 1 is a schematic cross-sectional view (a part) showing one embodiment of an internal combustion engine having sliding contact-making structures of the present invention. An engine 1 depicted in the Figure is a four-cycle internal combustion engine in which gasoline is used as fuel, and installed in a motorcycle. The internal combustion engine I has a crankcase 2. A crankshaft 4 is accommodated in a crank room 3 of the crank case 2, and the crankshaft 4 is pivoted in the crankcase 2 so as to freely rotate around a shaft center. Cylinder 6 is mounted on the upper side of the crankcase 2. The cylinder 6 has a cylinder unit 7 which is physically integrated on the upper side of the crankcase 2 using an integration device so that the cylinder unit 7 can be freely put on and taken off. The cylinder unit 7 has a cylinder bore 9 having a circular cross-section in the direction that an axial axis 8 is upright. The bottom of the cylinder bore 9 is communicated with the crank room 3, and the upper end of the cylinder bore 9 is closed with a cylinder head 10. The cylinder head 10 is fixed on the upper end of the cylinder unit 7 in such a way that the head can be freely put on and taken off. A piston 12 is fitted into the cylinder bore 9 of the cylinder unit 7 in such a way that the piston can slide freely in the vertical direction. A connecting bar 14 connects the crankshaft 4 at one end, and the piston 12 via a piston pin 13 at the other end. Accordingly, the crankshaft 4 and the piston 12 are connected so as to operate together via the connecting bar 14. In the cylinder bore 9, the space surrounded by the cylinder head 10 and the piston 12 constitutes a combustion chamber 15, when the piston 12 is on the side of the upper dead point position (indicated by the two-dash broken line in FIG. 1). An intake port 17 and an exhaust port 18 which connects the combustion chamber 15 and the outside of the cylinder head 10 are disposed in the cylinder head 10. In the intake port 17 and the exhaust port 18, an intake valve 19 and an exhaust valve 20 are placed for opening and closing these ports. The combustion chamber 15 is provided with an ignition plug 21 (indicated by the two-dash broken line). When the piston 12 goes down to approximately the lower dead point position (indicated by the solid line in FIGS. 1 and 2) and the exhaust valve 19 is open, a mixed gas 23 is introduced into the cylinder bore 9 via the inhalation port 17. When the piston 12 goes up from the lower dead point position, the mixed gas 23 is compressed, and ignited with the ignition plug 21 in the combustion chamber 15. Accordingly, the internal combustion engine I is operated, and energy is put out via the crankshaft 4. The exhaust gas 24 generated by ignition and combustion is discharged through the exhaust port 18 when the exhaust valve 20 is open. In addition, the cylinder unit 7 is provided with a cooling jacket 25 which prevents the cylinder unit 7 from being overheated due to combustion heat.

Alternatively, the crankcase 2 and the cylinder unit 7 can be integrated as one piece, and installed in a automobile.

Sliding Structures

In the Figure, the piston 12 has a piston body 28 aligned with the axial center 8 which comprises a piston head **28*a* in a disc shape aligned with the axial center 8, as well as a skirt area 28*b* which extends downwards in the axial direction from the outer surface of the piston head 28*a*. Three circumferential grooves 29 are provided in a row in the vertical direction on the outer surface of the piston body 28. A piston ring 30 is fitted into each groove 29 in such a way that the piston rings are freely put on and taken off. The upper piston ring is a compression ring, and the lower piston ring is an oil ring. Each outer surface of the piston rings 30 is resilient and freely slides in the axial direction upon an inside surface 31 of the cylinder bore 9 while pressing on the inside surface 31. The outer surfaces of the piston rings 30 function as sliding surfaces upon the inside surface 31, and keep the combustion chamber 15** airtight.

PLATING COATING

The cylinder unit 7, the cylinder head 10 and the piston body 28 all are made of aluminum alloys. A plating coating 33 is deposited by electric plating on the inside surface 31 where the inside surface 31 and the piston 12 are in sliding contact. The plating coating 33 is firmly bonded to the base material of the inside surface 31. This plating coating 33 is composed of nickel (Ni) as the main component and SiC which is contained in the Ni in a dispersed state (dispersoid). The surface of the plating coating 33 has been finished with a honing treatment.

Figure 2:
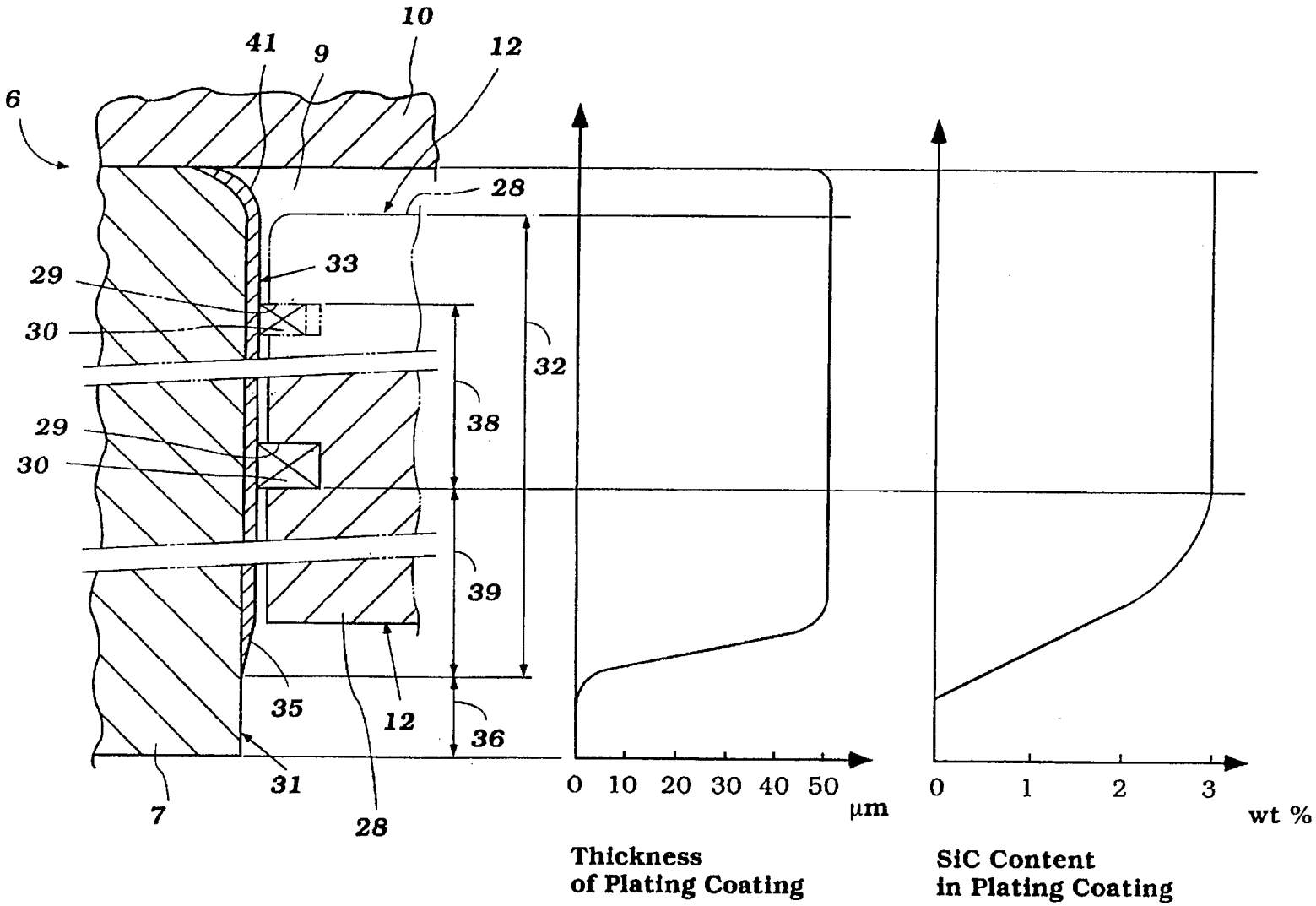
FIG. 2 is a schematic enlarged vertical cross-sectional view (a part) illustrating one embodiment of sliding contact-making structures according to the present invention, in which the plating coating has the distribution of the dispersoid content in the axial direction shown in the right graph, the thickness in the axial direction shown in the left graph. The broken line (two-dash) shows the upper dead point position of the piston while the solid line shows the lower dead point position of the piston.

In FIG. 2, the thickness at an edge area 35 of the plating coating 33 on the side of the crankshaft 4 is tapered towards the side of the crankshaft 4. In this case, the length of the tapered edge area 35 in the direction of the axial center 8 is approximately 2 mm. The tapering reduction of the thickness starts approximately at the lower dead point position of the piston skirt. The thickness of the plating coating 33 is approximately 50 μm after a honing treatment in this case (100 μm before the honing treatment). By constituting the above structure, the surface of the edge area 35 of the plating coating 33 on the side of the crankshaft 4 and an unplated area 36 of the inside surface 31 of the cylinder unit 37 continues smoothly, so that it can be prevented from forming a step-like edge at the boundary of the edge area 35 of the plating coating 33 and the unplated area 36 of the inside surface 31. As a result, little stress or impact caused by reciprocal sliding of the piston upon the plating coating focuses on the edge area.

In FIG. 2, the SiC content (%) in the plating coating 33 is substantially the same through the surface 38 in sliding contact with the piston rings 30. Thus, although the piston rings 30 are in sliding contact with the inside surface 31 of the cylinder unit 7 to retain airtightness in the combustion chamber 15, resistance to abrasion is improved as a whole since the ring-sliding surface 38 is given sufficient hardness by uniformly distributing the SiC content in the ring-sliding area 38 (3% by weight in this case). As a result, the life of the ring-sliding area 38 is extended. The SiC content in an area 39 of the plating coating 33, which is below the ring-sliding area 38 in the Figure (closer to the crankshaft side), is reduced relative to that in the ring-sliding area 38. That is, the hardness in the area 39 of the plating coating 33, which only the piston body 28 touches, is lowered. Accordingly, unnecessary abrasion of the piston body 28 in sliding contact with the area 39 of the plating coating 33 as well as seizing can be effectively prevented. The tapering reduction of the SiC content takes place gradually towards the crankshaft side.

An edge 41 of the inside surface 31 on the side of the cylinder head 10 is convex, and the plating coating 33 is also formed thereon. The thickness of the plating coating 33 is substantially the same through out the edge 41, except for the very end of the edge 41. Based on the above structure, the plating coating 33 is firmly bonded to the base material of the inside surface 31 of the cylinder unit 7 at the edge 41 of the inside surface 31, thereby certainly preventing peeling off of the plating coating 33 from the base material. In addition, the edge 41 of the plating coating 33 has a large curvature, thereby preventing deposition of exhaust carbon on the surface of the edge 41.

Plating Method

Figures 3, 3A:
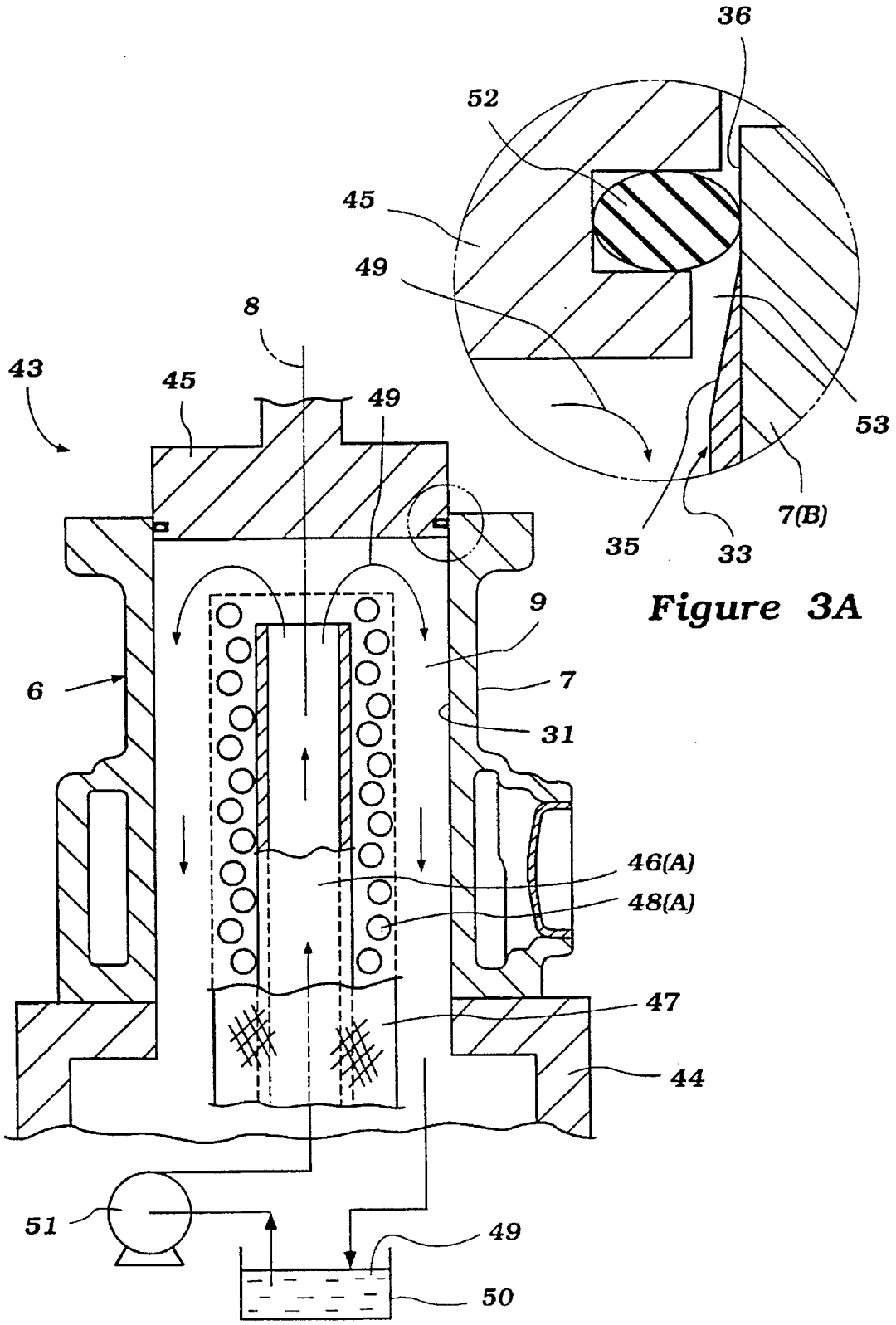
FIG. 3 is a schematic vertical cross-sectional view (a part) illustrating a plating system adapted to plate the inside surface of the cylinder unit of the present invention, in which the cylinder unit is placed upside down (the side of a crank shaft is up in the Figure). The upper right circled view is an enlarged cross-sectional view of the sealing area.

FIG. 3 is a schematic view (a part) illustrating a plating system adapted to plate the inside surface of the cylinder unit usable in the present invention, in which the cylinder unit is placed upside down (the side of a crank shaft is up in the Figure).

A plating apparatus 43 is provided with a base 44 on which a cylinder unit 7 stands upright, a cover 45 for closing the upper opening of a cylinder bore 9 of the cylinder unit 7 (capable of freely opening and closing), a longitudinal pipe 46 which is inserted into the cylinder bore 9 through the lower opening of the cylinder bore 9, a rectangular permeable net unit 47 which wholly surrounds the pipe 46 slightly apart from the pipe 46, and a number of nickel balls 48 accommodated in the space surrounded by the pipe 46 and the net unit 47. The plating apparatus is also provided with a tank 50 for storing a plating solution 49, and a pump 51 for pumping the plating solution 49 out of the tank 50 to the inside of the cylinder bore 9.

As illustrated in the enlarged circled figure in FIG. 3, a sealing portion 52 is fitted on a lower part of the circumferential outer surface of the cover 45 which is fitted into the upper opening of the cylinder bore 9. The boundary area between the upper opening edge of the cylinder bore 9 and the cover 45 is sufficiently sealed with the seal portion 52.

A voltage is impressed between the pipe 46 and the nickel balls 48, and is designated as a positive electrode A. The pipe 46 and the nickel balls 48 are aligned with the axial center 8. On the other hand, the cylinder unit 7 itself is designated as a negative electrode B. The plating solution 49 is supplied to the cylinder bore 9 by a pump 51 in the direction indicated by the arrow in the Figure, and flows inside the cylinder bore 9. While the plating solution flows, electric plating is conducted on the inside surface 31, and the plating coating 33 is formed thereon.

At the edge on the side of the crankshaft 4, a circumferential gap 53 is formed by the inside surface 31 of the cylinder unit 7, the sealing portion 52 and the outer circumferential surface of the cover 45 as illustrated in the enlarged circled figure in FIG. 3. The flow rate of the plating solution in the circumferential gap is conspicuously slow relative to that on the ring-sliding surface 38. Accordingly, the edge of the plating coating 33 is tapered. The electric current density is also low in the circumferential gap 53 since the distance from the electrode A is relatively far, affecting the thickness of the plating coating 33. When the face side of the cover 45 is located at a position corresponding to the lower dead point position of the .piston, the plating coating having a thickness illustrated in FIG. 2 can be formed.

Further, in this case, the pipe 46 and the nickel balls 48 are placed in such a way that the upper end of the position electrode A, i.e., the pipe 46 and the nickel balls 48 are located apart from the cover 45, i.e., apart from the edge of the cylinder unit 7 on the side of the crankshaft 4 (the upper end in this Figure) towards the side of the cylinder head 10 (the lower end in this Figure). By constituting the above structure, the electric current density in the plating solution 49 is reduced towards the edge of the crankshaft 4 in the upper area (in the axial direction) of the inside surface 31 of the cylinder unit 7 when conducting electric plating. The thickness of the plating coating 33 formed is proportionally correlated with the intensity of the electric current density. Thus, when the positive electrode A is placed so as to be surrounded by the ring-sliding surface 38, and the end of the positive electrode A is located between the ring-sliding surface 38 and the edge on the side of the crankshaft 4, the SiC content in the ring-sliding surface 38 on the inside surface 31 in sliding contact with the piston rings 30 is substantially the same in the axial direction, and the SiC content in the area 39 closer than the ring-sliding surface 38 to the side of the crankshaft 4 is reduced relative to that in the ring-sliding surface 38. In addition, on the area 39, the flow of the plating solution is disturbed since the plating solution 49 flows out of the inside to the outside of the hollow electrode A, thereby reducing the SiC content. In the circumferential gap 53, the electric current density is even lower since the distance from the electrode A is farther, thereby reducing the SiC content to a great extent in the circumferential gap 53. As a result, the distribution of the SiC content illustrated in FIG. 2 can be obtained.

The plating coating deposited on the inside cylinder surface of the cylinder unit used in the present invention has desirably been formed in connection with an improved plating system, the details of which are set forth in a U.S. patent application entitled "Plating Liquid, Plating Method and Plating Cylinder," Ser. No. 08/299,838, filed on Sep. 1, 1994 (claiming priority from Japanese Patent Application No. 218753, filed Sep. 2, 1993), which is hereby incorporated herein by reference. Further, the plating coating deposited on the inside cylinder surface of the cylinder block of the present invention may also be a non-homogenous composite plating coating formed by an improved plating system, the details of which are set forth in U.S. patent applications entitled "Non-homogenous Composite Plating Coating," Ser. No. 08/391,504, filed Feb. 21, 1995, and "Plating Method and Plating System for Non-homogenous Composite Plating Coating," Ser. No. 08/391,505, filed Feb. 21, 1995 (both claiming priority from Japanese Patent Application No. 22640, filed Feb. 21, 1994), which are hereby incorporated herein by reference. Further, the plating coating deposited on the inside cylinder surface of the cylinder unit used in the present invention may also be a plating coating formed in a limited area by an improved plating system, the details of which are set forth in U.S. patent applications entitled "Sleeveless Cylinder Block Without Marginal Plating Coating," Ser. No. 08/406,691, filed Mar. 20, 1995 (claiming priority from Japanese Patent Application No. 74317, filed Mar. 18, 1994), which is hereby incorporated herein by reference. The sliding contact-making structures in an internal combustion engine in the present invention may also have a plating coating finished with a fine honing treatment or plateau honing treatment as well as a piston with a piston ring covered with a vapor deposition layer, the details of which are set forth in U.S. patent application entitled "Sliding Contact-Making Structures in Internal Combustion Engine," Ser. No. unknown, filed May 26, 1995 (claiming priority from Japanese Patent Application No. 17364, filed Jun. 30, 1994), which is hereby incorporated herein by reference.

It will be understood by those of skill in the art that numerous variations and modifications can be made without departing from the spirit of the present invention. Therefore, it should be clearly understood that the forms of the present invention are illustrative only and are not intended to limit the scope of the present invention.

We claim:

1. A method for forming a plating coating on the inside surface of a cylinder unit of an internal combustion engine, comprising the steps of:

(a) sealing one end of a cylinder unit on the side of a crankshaft by fitting a cover having a sealing portion circumferentially provided on the side into the inside of the cylinder unit, wherein the sealing portion circumferentially touches the inside surface of the cylinder unit near said end of the cylinder, and a gap is formed circumferentially by the side of the cover, the sealing portion and the inside surface of the cylinder unit;

(b) inserting an electrode inside said cylinder unit from the other end of the cylinder unit;

(c) permitting a plating liquid containing a dispersoid substance-forming material to flow in a path formed by the inside surface of the cylinder unit, the electrode and the cover; and (d) impressing a voltage between said inside surface of the cylinder unit and said electrode to give an electric current density therebetween so as to form a plating coating on said surface of the cylinder unit, wherein said electrode is positive while said inside surface of the cylinder unit is negative, whereby the thickness of said plating coating on the inside surface of the cylinder unit is tapered off in the axial direction in the vicinity of the circumferential gap.

2. The method for forming a plating coating of claim 1, wherein, in step (b), said electrode is inserted inside said cylinder unit from the other end of the cylinder in such a way that the lengthwise side of said electrode is parallel to the inside surface of the cylinder unit, and, in step (d), a voltage is impressed under the conditions that the distance between the end of the electrode near the cover and the inside surface of the cylinder not parallel to the lengthwise side of the electrode on the side of a crankshaft is greater than the distance between the lengthwise side of the electrode and the inside surface of the cylinder parallel thereto, whereby the dispersoid content in the plating coating not in sliding contact with a piston ring, on the side of a crankshaft, is lower than that in sliding contact with the piston ring.

3. The method for forming a plating coating of claim 2, wherein said electrode is hollow, and said plating liquid flows out of the inside to the outside of said hollow electrode.

4. The method for forming a plating coating of claim 2, wherein said electrode is made of nickel.

5. The method for forming a plating coating of claim 2, wherein, in step (d), the end of said electrode is placed between the cover and a position corresponding in the axial direction to the lower dead point position of a piston ring.

6. A method for forming a plating coating on the inside surface of a cylinder unit of an internal combustion engine, comprising the steps of:

(a) sealing one end of a cylinder unit on the side of a crankshaft with a cover;

(b) inserting an electrode inside said cylinder unit from the other end of the cylinder in such a way that the lengthwise side of said electrode is parallel to the inside surface of the cylinder unit;

(c) permitting a plating liquid containing a dispersoid substance-forming material to flow in a path formed by the inside surface of the cylinder unit, the electrode and the cover; and (d) impressing a voltage between said inside surface of the cylinder unit and said electrode to give an electric current density therebetween so as to form a plating coating on said surface of the cylinder unit, wherein said electrode is positive while said inside surface of the cylinder unit is negative, under the conditions that the distance between the end of the electrode near the cover and the inside surface of the cylinder not parallel to the lengthwise side of the electrode on the side of a crankshaft is greater than the distance between the lengthwise side of the electrode and the inside surface of the cylinder parallel thereto, whereby the dispersoid content in the plating coating not in sliding contact with a piston ring, on the side of a crankshaft, is lower than that in sliding contact with the piston ring.

7. The method for forming a plating coating of claim 6, wherein said electrode is hollow, and said plating liquid flows out of the inside to the outside of said hollow electrode.

8. The method for forming a plating coating of claim 6, wherein said electrode is made of nickel.

9. The method for forming a plating coating of claim 6, wherein, in step (d), the end of said electrode is placed between the cover and a position corresponding in the axial direction to the lower dead point position of a piston ring.

* * * * *